US011799216B2

(12) United States Patent
Takeuchi et al.

(10) Patent No.: US 11,799,216 B2
(45) Date of Patent: Oct. 24, 2023

(54) TERMINAL AND WIRE WITH TERMINAL

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Shunya Takeuchi, Mie (JP); Masaaki Tabata, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/634,031

(22) PCT Filed: Aug. 7, 2020

(86) PCT No.: PCT/JP2020/030320
§ 371 (c)(1),
(2) Date: Feb. 9, 2022

(87) PCT Pub. No.: WO2021/039359
PCT Pub. Date: Mar. 4, 2021

(65) Prior Publication Data

US 2022/0294131 A1 Sep. 15, 2022

(30) Foreign Application Priority Data

Aug. 28, 2019 (JP) ..... 2019-155827

(51) Int. Cl.
*H01R 4/18* (2006.01)
*H01R 4/50* (2006.01)

(52) U.S. Cl.
CPC ..... *H01R 4/5083* (2013.01)

(58) Field of Classification Search
CPC ..... H01R 4/18; H01R 4/50; H01R 4/5066; H01R 4/5083
(Continued)

(56) References Cited

U.S. PATENT DOCUMENTS 3,916,085 A * 10/1975 Hansen ..... H01R 4/2495 174/94 R
4,692,122 A 9/1987 Montalbano
(Continued)

FOREIGN PATENT DOCUMENTS

JP S48-017681 U1 2/1973
JP 3-121661 U * 3/1990 ..... H01R 4/18
(Continued)

OTHER PUBLICATIONS

International Search Report dated Oct. 13, 2020 for WO 2021/039359 A1 (4 pages).

*Primary Examiner* — William H. Mayo, III
(74) *Attorney, Agent, or Firm* — Venjuris, P.C.

(57) ABSTRACT

A terminal to be connected to a front end part in an extending direction of a wire is provided with a terminal body including a sandwiching portion for sandwiching the wire, and a slide portion slidable along the extending direction of the wire with respect to the terminal body. The slide portion includes a pressurizing portion for pressurizing the sandwiching portion toward the wire. The terminal body is formed by a metal plate material in a bent state. The sandwiching portion includes a holding protrusion projecting toward the wire to contact the wire. The holding protrusion is formed by folding a tip portion of the sandwiching portion and overlapping the tip portion on an overlapping portion of the sandwiching portion. A first facing surface of
(Continued)

the overlapping portion and a second facing surface of the tip portion are facing each other and overlapped.

7 Claims, 8 Drawing Sheets

(58) Field of Classification Search
USPC ..... 174/74 R, 78, 84 R, 840, 94 R; 439/421
See application file for complete search history.

(56) References Cited

U.S. PATENT DOCUMENTS

| | | | | |
|---|---|---|---|---|
| 6,232,555 | B1 * | 5/2001 | Besler | H01R 4/182 174/84 C |
| 2005/0026515 | A1 | 2/2005 | Hashimoto et al. | |
| 2021/0234286 | A1 * | 7/2021 | Miyamura | H01R 13/02 |

FOREIGN PATENT DOCUMENTS

| | | | | |
|---|---|---|---|---|
| JP | H03-121661 | U1 | 12/1991 | |
| JP | WO 2019/159730 | A1 * | 8/2019 | H01R 4/50 |

* cited by examiner

TERMINAL AND WIRE WITH TERMINAL

CROSS REFERENCE TO RELATED APPLICATIONS

This application is a national phase of PCT application No. PCT/JP2020/030320, filed on 7 Aug. 2020, which claims priority from Japanese patent application No. 2019-155827, filed on 28 Aug. 2019, all of which are incorporated herein by reference.

TECHNICAL FIELD

The present disclosure relates to a terminal and a wire with terminal.

BACKGROUND

Conventionally, a wire with terminal is known in which a terminal is connected to a core exposed from an end of a wire. Such a terminal may include, for example, a crimping portion to be crimped to the core exposed from the end of the wire from outside.

The terminal is crimped to the wire, for example, as follows. First, the terminal having a predetermined shape is formed by press-working a metal plate material. Subsequently, the terminal is placed on a placing portion of a lower mold located on a lower side, out of a pair of molds relatively movable in a vertical direction. Subsequently, the core exposed from the end of the wire is overlapped and placed on the crimping portion of the terminal. Thereafter, one or both of the pair of molds are moved in directions approaching each other and the crimping portion is sandwiched between a crimper portion of an upper mold and the placing portion of the lower mold, whereby the crimping portion is crimped to the core of the wire. In the above way, the terminal is connected to the end of the wire (see Patent Document 1).

PRIOR ART DOCUMENT

Patent Document

Patent Document 1: JP 2005-050736 A

SUMMARY OF THE INVENTION

Problems to be Solved

However, according to the above technique, since a relatively large-scale facility such as the molds or a jig for crimping the crimping portion of the terminal to the core of the wire is necessary, facility investment is necessary and there is a problem of increasing manufacturing cost.

To solve the above problem, the following terminal is considered. The terminal includes a terminal body having a sandwiching portion deformable along a direction intersecting an extending direction of a wire and a slide portion movable along the extending direction of the wire with respect to the terminal body. The slide portion includes a pressurizing portion for pressing the sandwiching portion against the wire with the wire disposed in the sandwiching portion.

It is considered as a virtual technique to provide the sandwiching portion of the terminal body in such a terminal with a holding protrusion formed by a part projecting from a side edge of the sandwiching portion being folded onto the sandwiching portion. The holding protrusion projects toward the wire from the sandwiching portion. The wire is pressed by the holding protrusion and held in the sandwiching portion.

If the holding protrusion slides together with the wire and receives a rearward force along the extending direction of the wire, for example, by the wire being pulled, the folded holding protrusion may be turned up. In this case, the electrical connection reliability of the terminal and the wire may be reduced.

The technique disclosed in this specification was completed on the basis of the above situation and aims to provide a terminal with improved connection reliability of the terminal and a wire.

Means to Solve the Problem

The present disclosure is directed to a terminal to be connected to a front end part in an extending direction of a wire, the terminal being provided with a terminal body including a sandwiching portion for sandwiching the wire, and a slide portion slidable along the extending direction of the wire with respect to the terminal body, wherein the slide portion includes a pressurizing portion for pressurizing the sandwiching portion toward the wire, the terminal body is formed by a metal plate material in a bent state, the sandwiching portion includes a holding protrusion projecting toward the wire to contact the wire, the holding protrusion is formed by folding a tip portion of the sandwiching portion and overlapping the tip portion on an overlapping portion of the sandwiching portion, a first facing surface of the overlapping portion and a second facing surface of the tip portion are facing each other and overlapped, and a first fitting portion provided on the first facing surface and a second fitting portion provided on the second facing surface are concavo-convexly fit.

Effect of the Invention

According to the present disclosure, the connection reliability of a terminal and a wire can be improved.

DETAILED DESCRIPTION TO EXECUTE THE INVENTION

Description of Embodiments of Present Disclosure

Figure 1:
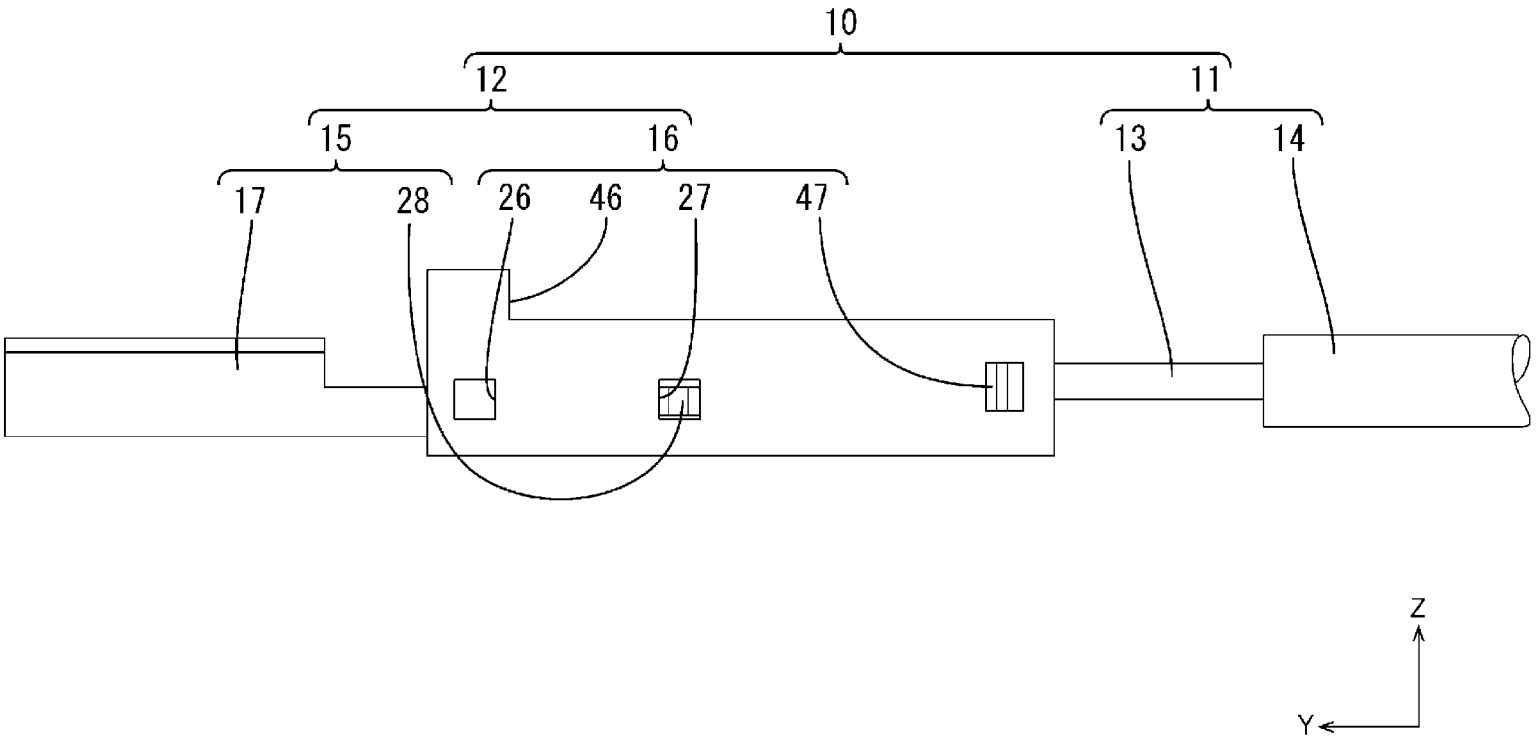
FIG. 1 is a side view showing a wire with terminal according to a first embodiment.

First, embodiments of the present disclosure are listed and described.

(1) The present disclosure is directed to a terminal to be connected to a front end part in an extending direction of a wire, the terminal being provided with a terminal body including a sandwiching portion for sandwiching the wire, and a slide portion slidable along the extending direction of the wire with respect to the terminal body, wherein the slide portion includes a pressurizing portion for pressurizing the sandwiching portion toward the wire, the terminal body is formed by a metal plate material in a bent state, the sandwiching portion includes a holding protrusion projecting toward the wire to contact the wire, the holding protrusion is formed by folding a tip portion of the sandwiching portion and overlapping the tip portion on an overlapping portion of the sandwiching portion, a first facing surface of the overlapping portion and a second facing surface of the tip portion are facing each other and overlapped, and a first fitting portion provided on the first facing surface and a second fitting portion provided on the second facing surface are concavo-convexly fit.

By adopting the above configuration, even if the holding protrusion is going to slide together with the wire and be displaced in the extending direction of the wire 11, for example, when the wire is pulled, the turning-up of the holding protrusion formed by being folded can be suppressed by concavo-convexly fitting the second fitting portion of the holding protrusion and the first fitting portion of the sandwiching portion. In this way, the connection reliability of the terminal and the wire can be improved.

(2) Preferably, the tip portion of the sandwiching portion has a contact surface for contacting the wire on a surface opposite to the second facing surface, the contact surface is formed with a recess, and a part of the tip portion corresponding to the recess is formed with the second fitting portion projecting from the second facing surface.

By forming the recess in the contact surface, the recess performs a serration function. That is, a pressure concentrates on a contact part of an opening edge of the recess and a core of the wire and an oxide film formed on the surface of the core can be easily destroyed. In this way, the electrical connection reliability of the wire and the holding protrusion is improved. In forming this recess, a structure projecting from the second facing surface may be formed. By using this projecting structure as the second fitting portion, the second fitting portion can be efficiently formed. This can contribute to a cost reduction of the terminal.

(3) Preferably, the tip portion of the sandwiching portion has a contact surface for contacting the wire on a surface opposite to the second facing surface, the tip portion is provided with a through hole penetrating through the contact surface and the second facing surface, an opening of the through hole in the second facing surface serves as the second fitting portion, and the first fitting portion is shaped to project from the first facing surface toward the second fitting portion at a position corresponding to the second fitting portion.

The opening of the through hole in the contact surface performs a serration function and the electrical connection reliability of the wire and the holding protrusion can be improved. By using the opening of the through hole in the second facing surface as the second fitting portion, the second fitting portion can be efficiently formed. This can contribute to a cost reduction of the terminal.

(4) Preferably, a plurality of the first fitting portions and a plurality of the second fitting portions are provided while being spaced apart in the extending direction of the wire.

By providing the plurality of first fitting portions and the plurality of second fitting portions in the extending direction of the wire, the second fitting portions can be more firmly locked to the first fitting portions.

(5) A wire with terminal according to the present disclosure is provided with the terminal of any one of (1) to (4) described above, and a wire to be connected to the terminal.

Details of Embodiments of Present Disclosure

Hereinafter, embodiments of the present disclosure are described. The present invention is not limited to these illustrations and is intended to be represented by claims and include all changes in the scope of claims and in the meaning and scope of equivalents.

First Embodiment

A first embodiment of the present disclosure is described with reference to FIGS. 1 to 7. A wire with terminal 10 according to the first embodiment includes a wire 11 and a terminal 12 to be connected to the wire 11. In the following description, a direction indicated by an arrow Z is referred to as an upward direction in a vertical direction, a direction indicated by an arrow Y is referred to as a forward direction in a front-rear direction and a direction indicated by an arrow X is referred to as a leftward direction in a lateral direction. Note that, for a plurality of identical members, only some members may be denoted by a reference sign and the other members may not be denoted by the reference sign.

[Wire 11]

As shown in FIG. 1, the wire 11 is disposed to extend in the front-rear direction (an example of an extending direction). The wire 11 is configured such that the outer periphery of a core 13 is surrounded by an insulation coating 14 made of insulating synthetic resin. The core 13 according to the first embodiment is composed of one metal wire. Note that the core 13 may be a stranded wire formed by twisting a plurality of metal thin wires. An arbitrary metal such as copper, copper alloy, aluminum or aluminum alloy can be appropriately selected as a metal constituting the core 13 if necessary. The core 13 according to the first embodiment is made of copper or copper alloy.

[Terminal 12]

As shown in FIG. 1, the terminal 12 includes a terminal body 15 made of metal and a slide portion 16 relatively slidable with respect to the terminal body 15.

[Terminal Body 15]

The terminal body 15 is formed by press-working a metal plate material into a predetermined shape. An arbitrary metal such as copper, copper alloy, aluminum, aluminum alloy or stainless steel can be appropriately selected as a metal constituting the terminal body 15 if necessary. The terminal body 15 according to the first embodiment is made of copper or copper alloy. A plating layer may be formed on the surface of the terminal body 15. An arbitrary metal such as tin, nickel or silver can be appropriately selected as a metal constituting the plating layer if necessary. Tin plating is applied to the terminal body 15 according to the first embodiment.

Figure 2:
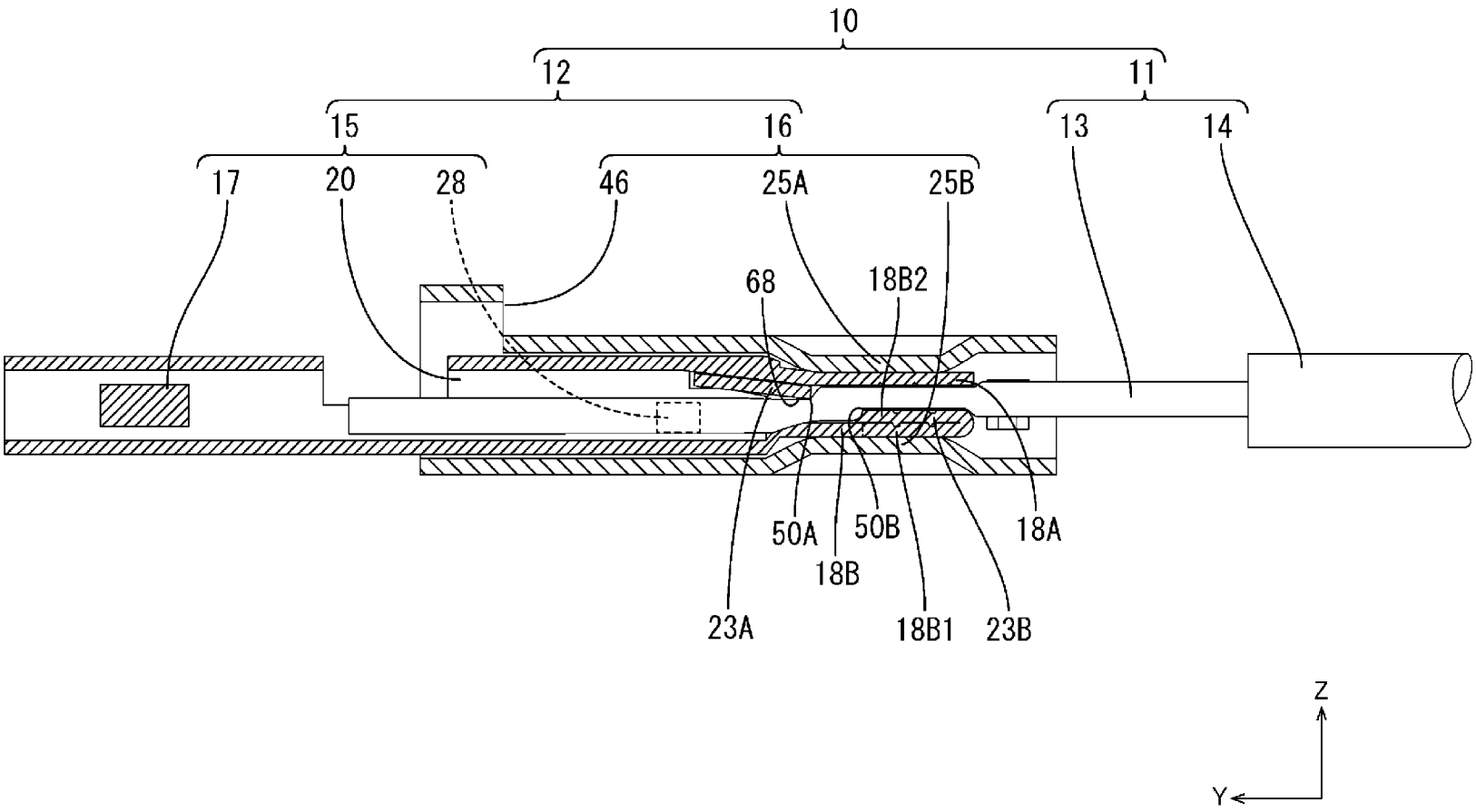
FIG. 2 is a side view in section showing the wire with terminal.

As shown in FIG. 2, the terminal body 15 includes a tube portion 17, into which an unillustrated mating terminal is inserted, and a wire connecting portion 20 located behind the tube portion 17 and to be connected to a front end part of the wire 11. The wire connecting portion 20 includes an upper sandwiching portion 18A and a lower sandwiching portion 18B extending rearward.

As shown in FIG. 2, the tube portion 17 is in the form of a rectangular tube extending in the front-rear direction. The front end of the tube portion 17 is open, so that the mating terminal is insertable. An unillustrated resilient contact piece is disposed inside the tube portion 17. The resilient contact piece resiliently contacts the mating terminal inserted into the tube portion 17, whereby the tube portion 17 and the mating terminal are electrically connected.

[Upper Sandwiching Portion 18A, Lower Sandwiching Portion 18B]

Figure 3:
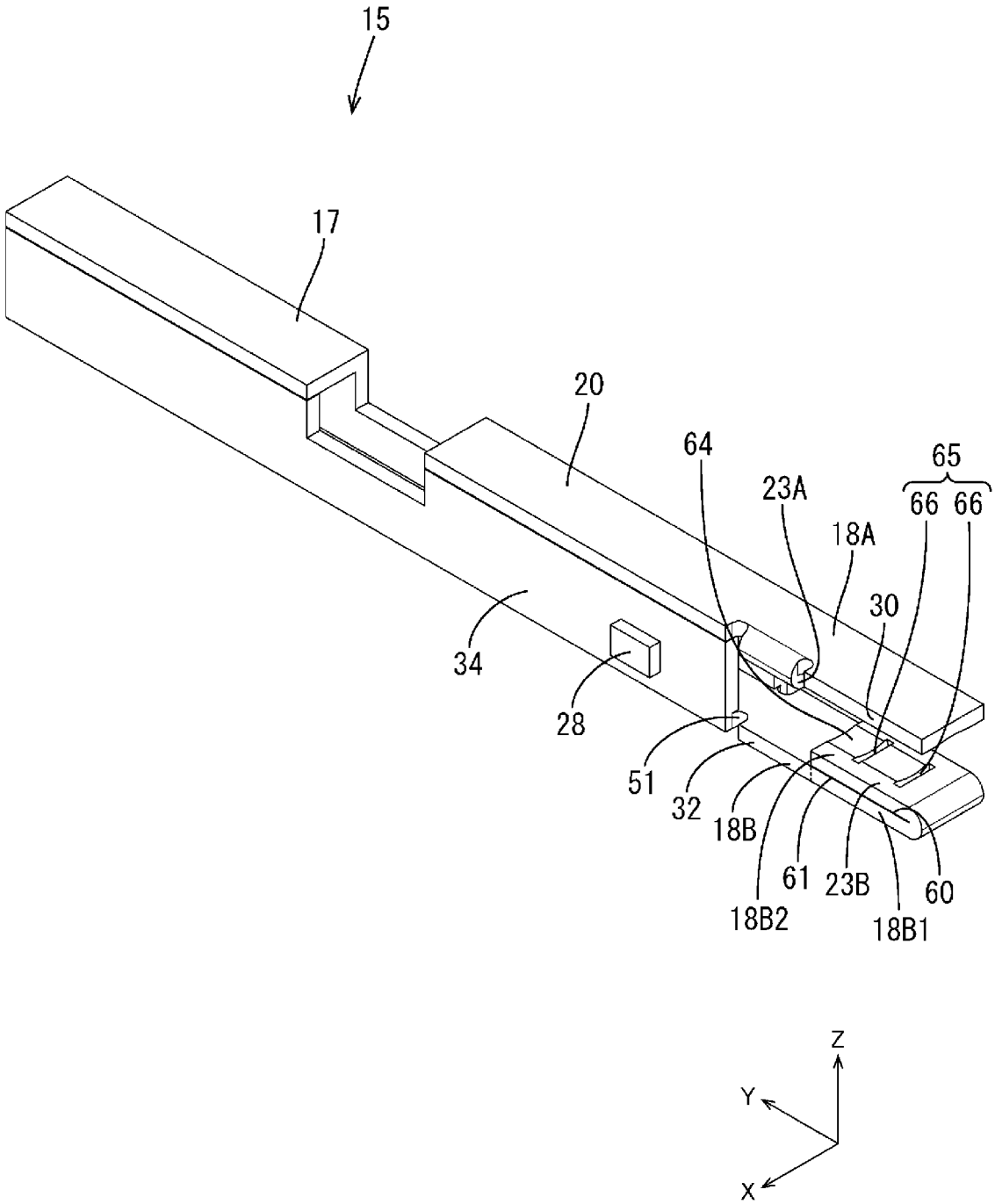
FIG. 3 is a perspective view showing a terminal body.

As shown in FIG. 3, the wire connecting portion 20 in the form of a rectangular tube is provided behind the tube portion 17. The upper sandwiching portion 18A (an example of a sandwiching portion) is provided to extend rearward on a rear end part of the upper wall of the wire connecting portion 20, and the lower sandwiching portion 18B (an example of the sandwiching portion) is provided to extend rearward on a rear end part of the lower wall of the wire connecting portion 20. The upper and lower sandwiching portions 18A, 18B have a shape elongated in the front-rear direction. The upper and lower sandwiching portions 18A, 18B are formed to have substantially the same length in the front-rear direction. The wire connecting portion 20 is formed with a left side wall 34 in front of rising from a left side edge 30 of the upper sandwiching portion 18A and a left side edge 32 of the lower sandwiching portion 18B and a right side wall 35 in front of rising from a right side edge 31 of the upper sandwiching portion 18A and a right side edge 33 of the lower sandwiching portion 18B.

[Upper Holding Protrusion 23A]

As shown in FIG. 3, an upper holding protrusion 23A projecting downward is provided at a position forward of a rear end part on the lower surface of the upper sandwiching portion 18A. The upper holding protrusion 23A is formed by a part of the upper sandwiching portion 18A projecting from the left side edge 30 being closely folded onto the lower surface of the upper sandwiching portion 18A. A right end part of the upper holding protrusion 23A is formed not to project rightward from the right side edge 31 of the upper holding protrusion 18A. As shown in FIG. 2, the lower surface of the upper holding protrusion 23A serves as an upper contact surface 68 for contacting the core 13 of the wire 11.

[Lower Holding Protrusion 23B]

Figure 6:
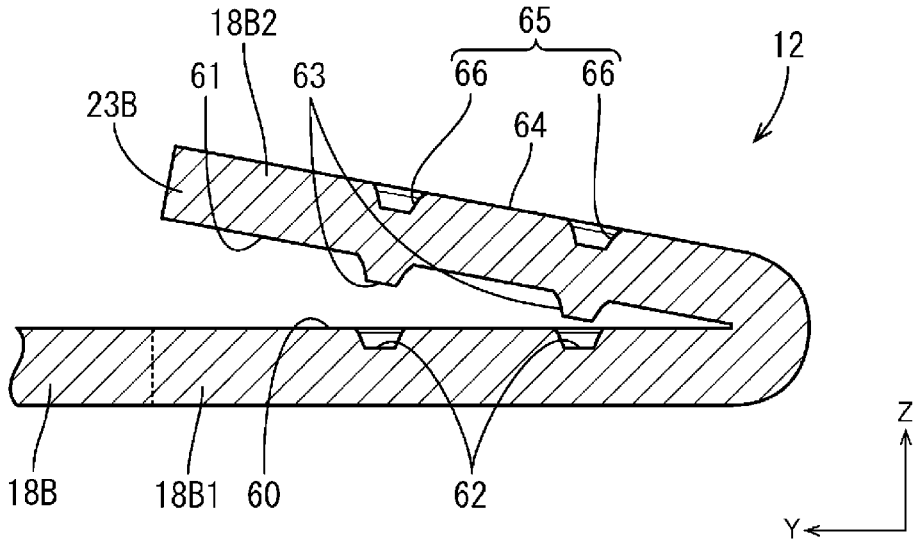
FIG. 6 is a diagram showing a state before first fitting portions and second fitting portions in the terminal body are concavo-convexly fit.
Figure 7:
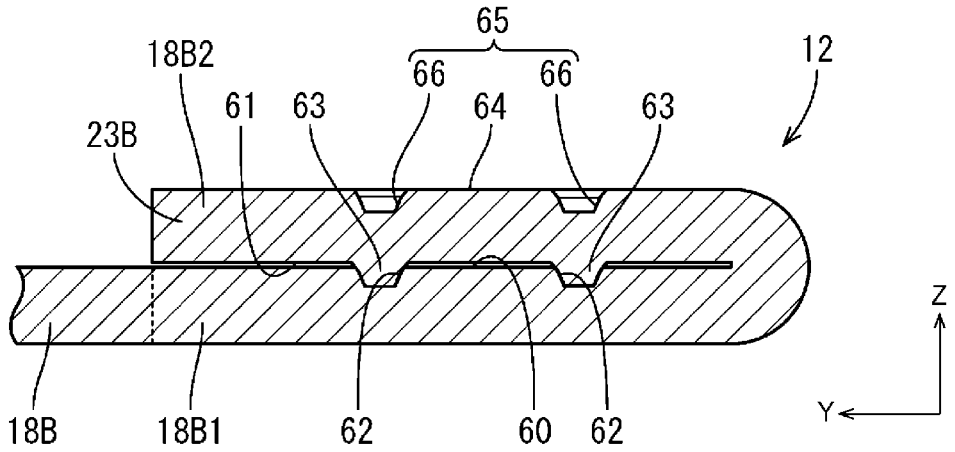
FIG. 7 is a diagram showing a state after the first and second fitting portions in the terminal body are concavo-convexly fit.

As shown in FIG. 3, a lower holding protrusion 23B projecting upward is provided on a rear end part of the upper surface of the lower sandwiching portion 18B. As shown in FIGS. 6 and 7, the lower holding protrusion 23B is formed by a tip portion 18B2 projecting rearward from a rear end part of the lower sandwiching portion 18B being folded and closely overlapped on an overlapping portion 18B1 of the lower sandwiching portion 18B. A first facing surface 60, which is the upper surface of the overlapping portion 18B1, and a second facing surface 61, which is the lower surface of the tip portion 18B2 (i.e. lower holding protrusion 23B) are facing each other and overlapped. A region of the lower sandwiching portion 18B provided with the lower holding protrusion 23B is unlikely to deflect by being reinforced by the lower holding protrusion 23B. The upper surface of the lower holding protrusion 23B serves as a lower contact surface (contact surface) 64 for contacting the core 13 of the wire 11.

[Recesses 66]

Two recesses 66 are formed in the lower contact surface 64 of the lower holding protrusion 23B. The recesses 66 are recessed from the lower contact surface 64 of the lower holding protrusion 23B. The two recesses 66 are disposed while being spaced apart in the front-rear direction.

As shown in FIG. 2, the lower holding protrusion 23B and the upper holding protrusion 23A are provided at positions shifted in the front-rear direction. A rear end part of the upper holding protrusion 23A and a front end part of the lower holding protrusion 23B are somewhat separated in the front-rear direction. An interval between the rear end part of the upper holding protrusion 23A and the front end part of the lower holding protrusion 23B is set smaller than a diameter of the core 13. In this way, an edge 50A formed on the rear end part of the upper holding protrusion 23A and an edge 50B formed on the front end part of the lower holding protrusion 23B bite into the core 13.

The lower surface of the upper sandwiching portion 18A and the upper surface of the lower sandwiching portion 18B bite into an oxide film formed on the surface of the core 13 and peels off the oxide film, whereby a metal surface of the core 13 is exposed. By the contact of this metal surface and the upper and lower sandwiching portions 18A, 18B, the core 13 and the terminal body 15 are electrically connected.

Further, the upper contact surface 68 of the upper holding protrusion 23A and the lower contact surface 64 of the lower holding protrusion 23B bite into the oxide film formed on the surface of the core 13 and peels off the oxide film, whereby the metal surface of the core 13 is exposed. At this time, the recesses 66 formed in the lower contact surface 64 have a serration function for concentrating a pressure on contact parts of the opening edges of the recesses 66 and the core 13. In this way, the oxide film formed on the surface of the core 13 can be easily destroyed. By the contact of this metal surface and the upper and lower holding protrusion 23A, 23B, the core 13 and the terminal body 15 are electrically connected.

Further, the edge 50A formed on the rear end part of the upper holding protrusion 23A and the edge 50B formed on the front end part of the lower holding protrusion 23B bite into the core 13, whereby the oxide film formed on the surface of the core 13 is peeled off. In this way, the core 13 and the terminal body 15 are more reliably electrically connected.

[Left Easily Bendable Portion 51, Right Easily Bendable Portion 52]

Figure 4:
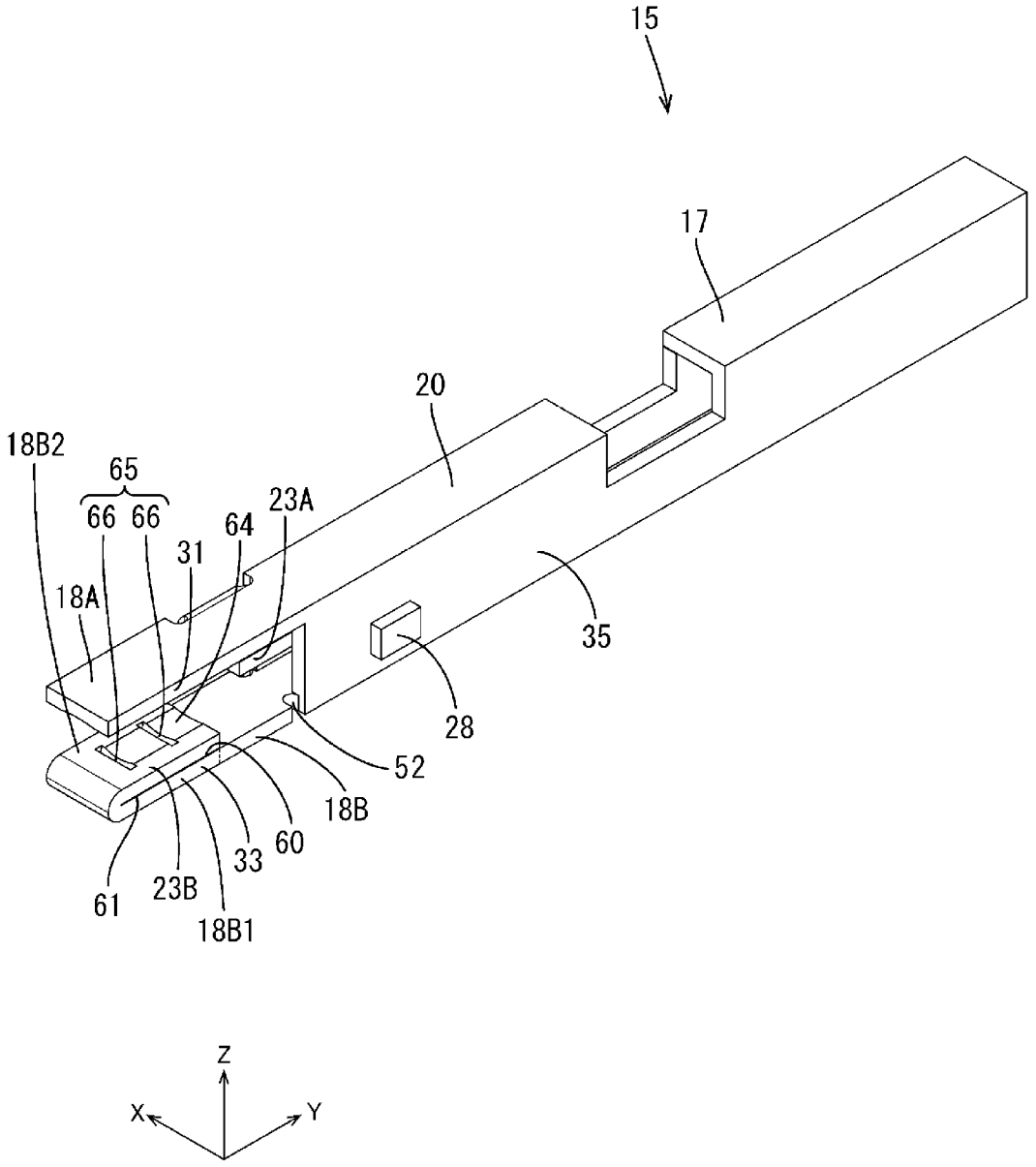
FIG. 4 is a perspective view showing the terminal body.

A front end part of the lower sandwiching portion 18B is provided with a left easily bendable portion 51 cut rightward from the left side edge 32 of the lower sandwiching portion 18B (see FIG. 3) and a right easily bendable portion 52 cut leftward from the right side edge 33 of the lower sandwiching portion 18B (see FIG. 4). The left and right easily bendable portions 51, 52 are provided at the same position in the front-rear direction. Out of the lower sandwiching portion 18B, a part provided with the left and right easily bendable portions 51, 52 is formed to be narrower than other parts in the lateral direction. In this way, the lower sandwiching portion 18B is bent with the left easily bendable portion 51 and the right easily bendable portion as a fulcrum.

[First Fitting Portions 62, Second Fitting Portions 63]

As shown in FIG. 7, two first fitting portions 62 are provided in the first facing surface 60. The two first fitting portions 62 are disposed while being spaced apart in the front-rear direction. Two second fitting portions 63 are provided on the second facing surface 61. The second fitting portions 63 are disposed while being spaced apart in the front-rear direction. The second fitting portions 62 are fit into the first fitting portions 62.

As shown in FIG. 7, the second fitting portions 63 are shaped to project downward from the second facing surface 61. The second fitting portions 63 are secondarily formed as the recesses 66 are formed. That is, the recesses 66 are formed by extruding parts of the lower holding protrusion 23B downward from the side of the lower contact surface 64. As the recesses 66 are formed, the parts of the lower holding protrusion 23B are extruded downward from the side of the second facing surface 61. In this way, the two second fitting portions 63 are formed. Thus, the respective second fitting portions 63 are formed at positions corresponding to the respective recesses 66 in the vertical direction. By using the parts secondarily formed as the recesses 66 are formed in this way as the second fitting portions 63, the second fitting portions 63 can be efficiently formed as compared to the case where second fitting portions are newly formed.

As shown in FIGS. 6 and 7, the first fitting portions 62 are formed to be open at positions corresponding to the second fitting portions 63 in the first facing surface 60. The first fitting portions 62 are recessed from the first facing surface 60 of the lower sandwiching portion 18B. When the lower holding protrusion 23B is folded onto the upper surface of the lower sandwiching portion 18B, the second fitting portions 63 of the lower holding protrusion 23B are inserted into the first fitting portions 62 of the lower sandwiching portion 18B. In this way, the first and second fitting portions 62, 63 are concavo-convexly fit and the lower holding protrusion 23B is locked to the lower sandwiching portion 18B. In this way, even if the lower contact surface 64 of the lower holding protrusion 23B is going to slide together with the core 13 of the wire 11 and be displaced rearwardly of the wire 11, for example, when the wire 11 is pulled rearward, the turning-up of the lower holding protrusion 23B formed by being folded can be suppressed.

[Slide Portion 16]

As shown in FIG. 2, the slide portion 16 is in the form of a rectangular tube extending in the front-rear direction. The slide portion 16 is formed into a predetermined shape by a known method such as press-working, cutting or casting. An arbitrary metal such as copper, copper alloy, aluminum, aluminum alloy or stainless steel can be appropriately selected as a metal constituting the slide portion 16 if necessary. The slide portion 16 according to the first embodiment is made of stainless steel although not particularly limited. A plating layer may be formed on the surface of the slide portion 16. An arbitrary metal such as tin, nickel or silver can be appropriately selected as a metal constituting the plating layer if necessary.

As shown in FIG. 2, an upward projecting jig contact portion 46 is formed on a front end part of the upper wall of the slide portion 16. A jig 45 to be described later is brought into contact with the jig contact portion 46 from behind (see FIG. 5).

As shown in FIG. 2, an upper pressurizing portion 25A projecting downward is provided on the lower surface of the upper wall of the slide portion 16 in a rear half of the slide portion 16. A lower pressurizing portion 25B projecting upward is provided on the upper surface of the lower wall of the slide portion 16. The front surface of the upper pressurizing portion 25A and that of the lower pressurizing portion 25B are formed with inclined surfaces. In this way, a rear end part of the upper sandwiching portion 18A and that of the lower sandwiching portion 18B are respectively guided to the upper and lower pressurizing portions 25A, 25B.

As shown in FIG. 1, partial lock receiving portions 26 are open at positions near front end parts in the front-rear direction in side walls of the slide portion 16. Further, full lock receiving portions 27 are open at positions behind the partial lock receiving portions 26 in the side walls of the slide portion 16. The partial lock receiving portions 26 and the full lock receiving portions 27 are resiliently lockable to locking projections 28 provided on the respective left and right side walls 34, 35 of the terminal body 15.

A state where the locking projections 28 of the terminal body 15 and the partial lock receiving portions 26 of the slide portion 16 are locked is a state where the slide portion 16 is held at a partial locking position with respect to the terminal body 15 (see FIG. 1). In this state, the upper and lower pressurizing portions 25A, 25B of the slide portion 16 are separated rearward from the rear end edges of the upper and lower sandwiching portions 18A, 18B of the terminal body 15. Further, in this state, an interval between the upper and lower sandwiching portions 18A, 18B is set larger than the diameter of the core 13.

Figure 5:
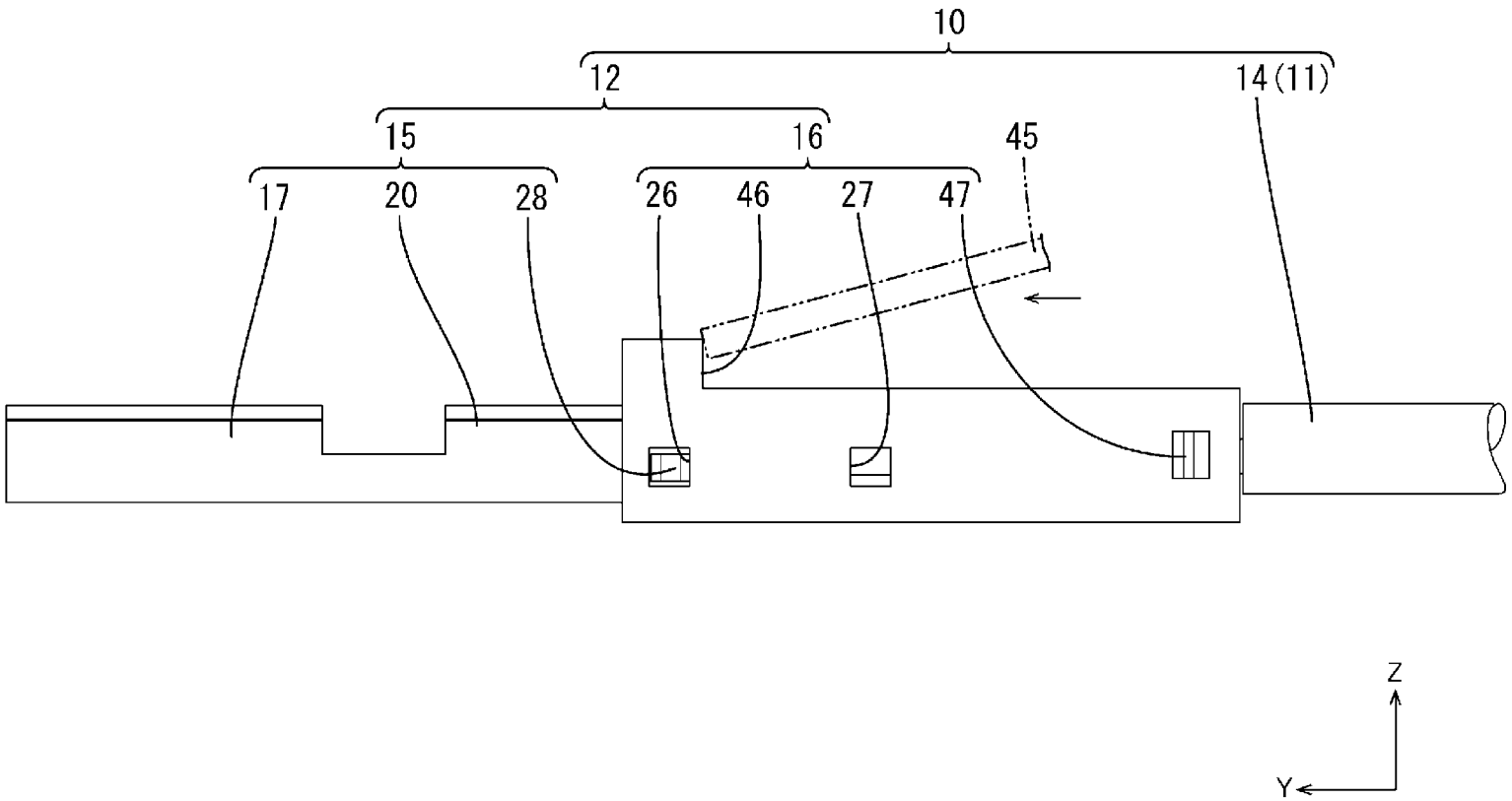
FIG. 5 is a side view showing a process of pushing a slide portion disposed at a partial locking position forward with respect to the terminal body.

A state where the locking projections 28 of the terminal body 15 and the full lock receiving portions 27 of the slide portion 16 are locked is a state where the slide portion 16 is held at a full locking position with respect to the terminal body 15 (see FIG. 5). In this state, the upper pressurizing portion 25A of the slide portion 16 is in contact with the upper sandwiching portion 18A from above the upper sandwiching portion 18A. Further, the lower pressurizing portion 25B of the slide portion 16 is in contact with the lower sandwiching portion 18B from below the lower sandwiching portion 18B.

As described above, the slide portion 16 is slidable along the front-rear direction (extending direction of the wire) between the partial locking position and the full locking position while being externally fit to a region of the terminal body 15 where the upper and lower sandwiching portions 18A, 18B are provided.

As shown in FIG. 2, with the slide portion 16 held at the full locking position with respect to the terminal body 15, the upper sandwiching portion 18A is bent downward by the upper pressurizing portion 25A pressing the upper sandwiching portion 18A from above. Further, the lower sandwiching portion 18B is bent upward by the lower pressurizing portion 25B pressing the lower sandwiching portion 18B from below. In this way, the core 13 is sandwiched in the vertical direction by the bent upper and lower sandwiching portions 18A, 18B with the core 13 disposed to extend in the front-rear direction (extending direction) in a space between the upper and lower sandwiching portions 18A, 18B and the slide portion 16 held at the full locking position with respect to the terminal body 15. That is, the upper sandwiching portion 18A contacts the core 13 from above by being pressed downward by the upper pressurizing portion 25A, and the lower sandwiching portion 18B contacts the core 13 from below by being pressed by the lower pressurizing portion 25B.

As shown in FIG. 2, with the slide portion 16 held at the full locking position with respect to the terminal body 15, the upper holding protrusion 23A of the upper sandwiching portion 18A presses the core 13 from above and the lower holding protrusion 23B of the lower sandwiching portion 18B presses the core 13 from below. The core 13 is pressed from above by the upper holding protrusion 23A and pressed from below by the lower holding protrusion 23B disposed at a position shifted from the upper holding protrusion 23A in the front-rear direction in this way, thereby being held in a state bent in the vertical direction. The core 13 is held by the upper and lower holding protrusions 23A, 23B while being cranked in a side view. Further, the core 13 and the terminal 12 are electrically connected also by the upper and lower holding protrusions 23A, 23B.

As shown in FIG. 5, the jig contact portion 46 is formed on the front end part of the upper wall of the slide portion 16. The jig 45 contacts the jig contact portion 46 from behind to push the slide portion 16 forward, whereby the slide portion 16 is movable forward. Note that the jig 45 is of a relatively small scale as compared to a mold and a facility for operating this mold. Thus, a cost increase due to the jig 45 is suppressed.

As shown in FIG. 5, a pair of guiding portions 47 projecting inwardly of the slide portion 16 are provided at positions near a rear end part of the slide portion 16 on both left and right side walls. The guiding portion 47 is formed to become narrower from a rear side toward a front side. The core 13 is guided into the slide portion 16 by sliding in contact with the inner surfaces of the guiding portions 47.

[Functions and Effects of First Embodiment]

Next, functions and effects of the first embodiment are described. According to the first embodiment, even if the lower holding protrusion 23B is going to slide together with the core 13 of the core 11 and be displaced in the extending direction of the wire 11, for example, when the wire 11 is pulled rearward, the second fitting portions 63 of the lower holding protrusion 23B and the first fitting portions 62 of the lower sandwiching portions 18B are concavo-convexly fit, whereby the turning-up of the lower holding protrusion 23B formed by being folded can be suppressed. In this way, the connection reliability of the terminal 12 and the wire 11 can be improved.

Further, by forming the recesses 66 in the lower contact surface 64, the recesses 66 perform a serration function. That is, a pressure concentrates on the contact parts of the opening edges of the recesses 66 and the core 13 of the wire 11 and the oxide film formed on the surface of the core 13 can be easily destroyed. In this way, the electrical connection reliability of the wire 11 and the lower holding protrusion 23B is improved. When the recesses 66 are formed to be recessed from the lower contact surface 64, structures projecting from the second facing surface 61 may be formed. By using these projecting structures as the second fitting portions 63, the second fitting portions 63 can be efficiently formed. This can contribute to a cost reduction of the terminal 12.

Further, by providing a plurality of (two in the first embodiment) the first fitting portions 62 and the second fitting portions 63 in the extending direction of the wire 11, the second fitting portions 63 can be more firmly locked to the first fitting portions 62.

Second Embodiment

Figure 8:
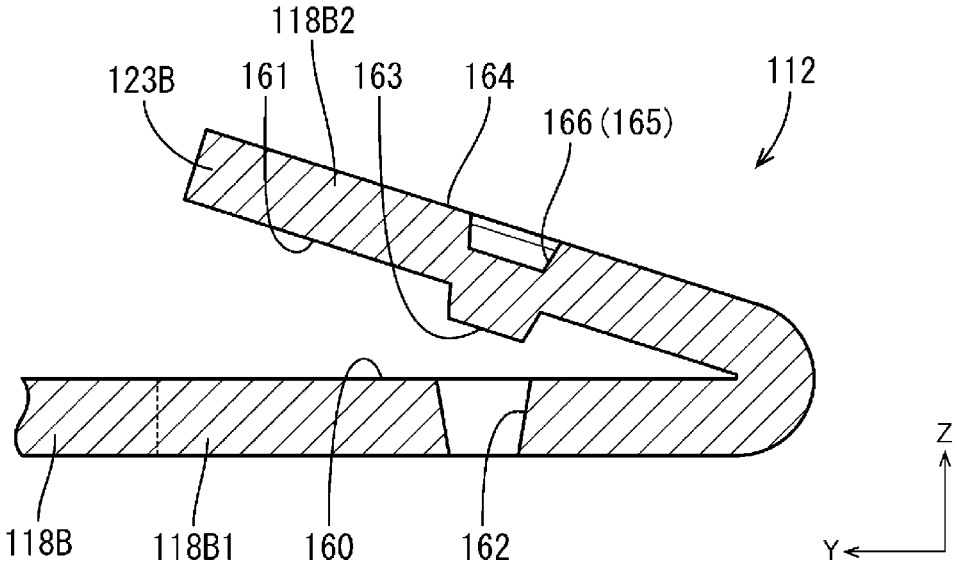
FIG. 8 is a diagram showing a state before a first fitting portion and a second fitting portion in a terminal body according to a second embodiment are concavo-convexly fit.
Figure 9:
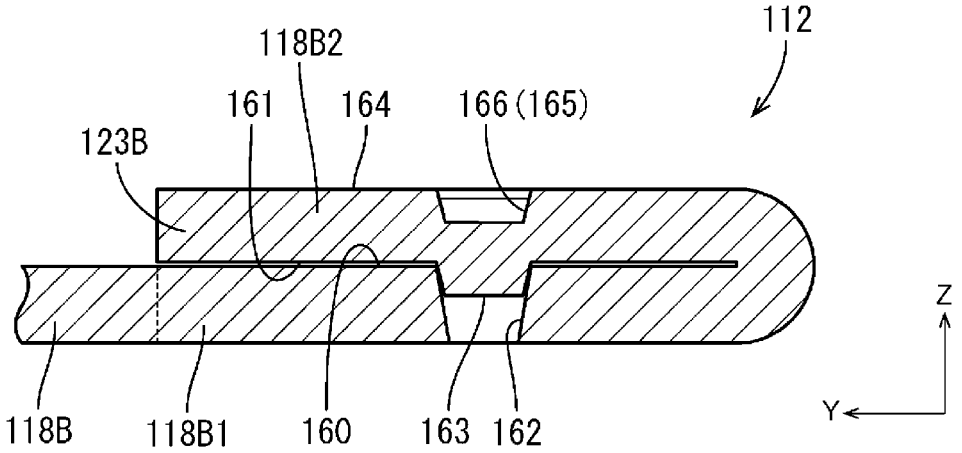
FIG. 9 is a diagram showing a state after the first and second fitting portions in the terminal body are concavo-convexly fit.

Next, a terminal 112 according to a second embodiment of the present disclosure is described with reference to FIGS. 8 and 9. A lower holding protrusion 123B in the terminal 112 is formed by a tip portion 118B2 of a lower sandwiching portion 118B being folded and closely overlapped on an overlapping portion 118B1 of the lower sandwiching portion 118B.

A lower holding protrusion 123B in the terminal 112 is formed with a recess 166. One recess 166 is provided in a lower contact surface 164 and has a serration function, similarly to the recesses 66 of the first embodiment. Further, one second fitting portion 163 is provided at a position corresponding to the recess 166 on a second facing surface 161.

The first fitting portion 162 in the lower sandwiching portion 118B is provided at a position corresponding to the second fitting portion 163 and formed to penetrate through the first facing surface 160 and the lower surface of the lower sandwiching portion 118B. If the lower holding protrusion 123B is folded onto the lower sandwiching portion 118B, the first and second fitting portions 162, 163 are concavo-convexly fit.

Since the first fitting portion 162 is formed to penetrate, the terminal 112 is reduced in weight, for example, as compared to a configuration where the first fitting portions 62 are formed to be recessed from the first facing surface 60 as in the first embodiment.

Since the other configuration is substantially the same as in the first embodiment, the same members are denoted by the same reference signs and repeated description is omitted.

Third Embodiment

Figure 10:
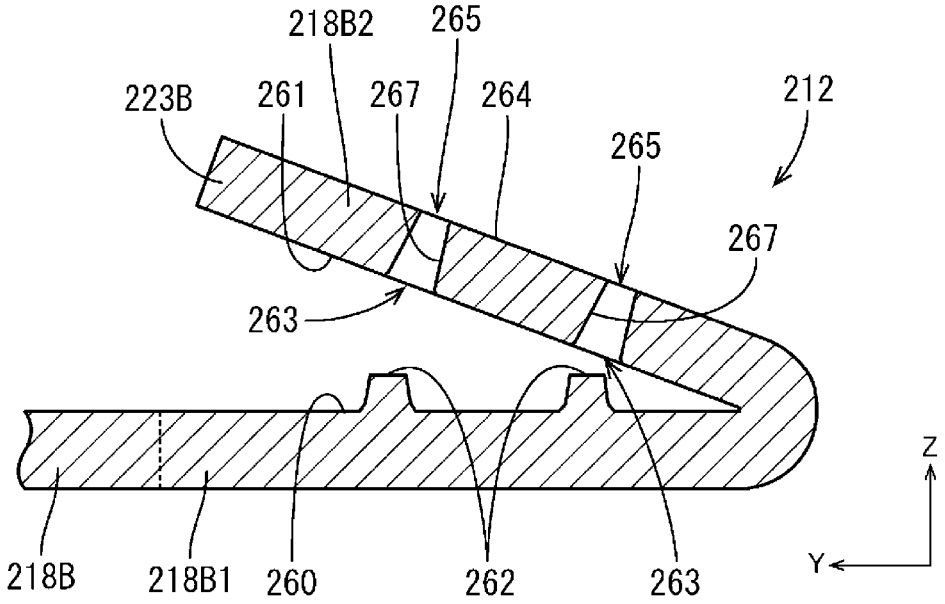
FIG. 10 is a diagram showing a state before first fitting portions and second fitting portions in a terminal body according to a third embodiment are concavo-convexly fit.
Figure 11:
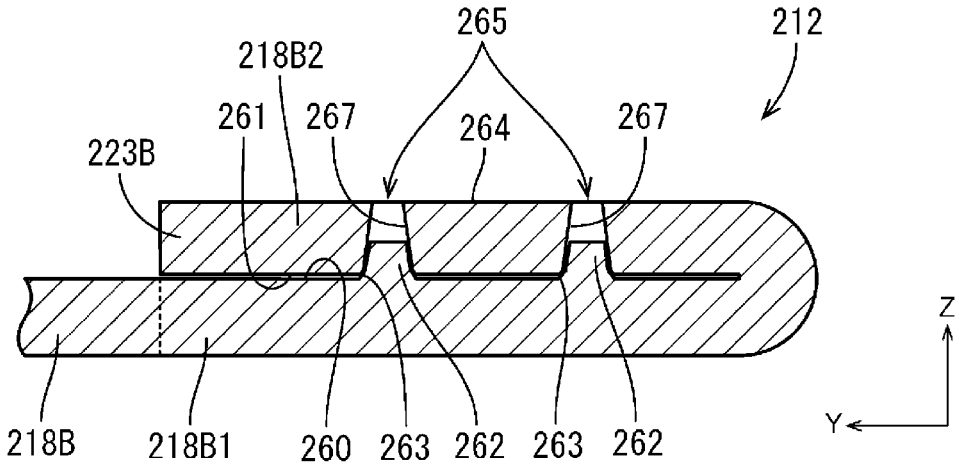
FIG. 11 is a diagram showing a state after the first and second fitting portions in the terminal body are concavo-convexly fit.

Next, a terminal 212 according to a third embodiment of the present disclosure is described with reference to FIGS. 10 and 11. A lower holding protrusion 223B in the terminal 212 is formed by a tip portion 218B2 of a lower sandwiching portion 218B being closely folded onto an overlapping portion 218B1 of the lower sandwiching portion 218B.

A lower holding protrusion 223B in the terminal 212 is formed with through holes 267 penetrating through a lower contact surface 264 and a second facing surface 261. Two through holes 267 are provided while being spaced apart in the front-rear direction.

Openings of the through holes 267 in the lower contact surface 264 have a serration function. Further, openings of the through holes 267 in the second facing surface 261 serve as second fitting portions 263. First fitting portions 262 are shaped to project upward from a first facing surface 260. The first fitting portions 262 are formed, for example, by welding on the first facing surface 260 or cutting the first facing surface 260.

The first fitting portions 262 are provided at positions corresponding to the second fitting portions 263. When the lower holding protrusion 223B is folded onto the lower sandwiching portion 218B, the first fitting portions 262 are inserted into the openings of the second fitting portions 263. In this way, the first and second fitting portions 262, 263 are concavo-convexly fit.

Since the other configuration is substantially the same as in the first embodiment, the same members are denoted by the same reference signs and repeated description is omitted.

[Functions and Effects of Third Embodiment]

Next, functions and effects of the third embodiment are described. According to the third embodiment, the openings of the through holes 267 in the lower contact surface 264 perform a serration function and the electrical connection reliability of a wire (wire 11 is not shown in the third embodiment since having the same configuration as in the first embodiment) and the lower holding protrusion 223B can be improved. Further, the second fitting portions 263 can be efficiently formed by using the openings of the through holes 267 in the second facing surface 261 as the second fitting portions 263. This can contribute to a cost reduction of the terminal 212.

Other Embodiment

The present disclosure is not limited to the above described and illustrated embodiments. For example, the following embodiments are also included in the technical scope of the technique disclosed in this specification.

(1) Although two recesses 66 are provided in the first embodiment and one recess 166 is provided in the second embodiment, there is no limitation to this. For example, three or more recesses may be provided. In this case, three or more second fitting portions and three or more first fitting portions may be provided to correspond to the number of the recesses.

(2) Although the lower holding protrusion 23B, 123B of the terminal 12, 112 is provided with the recess(es) 66, 166 having a serration function in the first and second embodiments, there is no limitation to this and a lower holding protrusion may not be provided with any recess.

(3) Although the first fitting portion(s) 62, 162, 262 and the second fitting portion(s) 63, 163, 263 are provided on the side of the lower sandwiching portion 18B, 118B, 218B in the first to third embodiments, there is no limitation to this. For example, first and second fitting portions may be provided on the side of an upper sandwiching portion.

(4) Although the lower holding protrusion 23B is formed by the part of the lower sandwiching portion 18B projecting rearward from the rear end part being closely folded onto the upper surface of the lower sandwiching portion 18B in the first embodiment, there is no limitation to this. For example, a lower holding protrusion may be formed by a part projecting laterally from either one of left and right side edge parts of a lower sandwiching portion being closely folded onto the upper surface of the lower sandwiching portion.

(5) Although the first fitting portions 262 are formed by welding on the first facing surface 260 or cutting the first facing surface 260 in the third embodiment, there is no limitation to this. For example, first fitting portion(s) may be formed by striking a lower sandwiching portion from a lower surface side like the second fitting portion(s) 63, 163 in the first and second embodiments. In this case, recess(es) is/are formed in the lower surface of the lower sandwiching portion.

LIST OF REFERENCE NUMERALS

10: wire with terminal
11: wire
12, 112, 212: terminal
13: core
14: insulation coating
15: terminal body
16: slide portion
17: tube portion
18A: upper sandwiching portion
18B, 118B, 218B: lower sandwiching portion
18B1, 118B1, 218B1: overlapping portion
18B2, 118B2, 218B2: tip portion
20: wire connecting portion
23A: upper holding protrusion
23B, 123B, 223B: lower holding protrusion
25A: upper pressurizing portion
25B: lower pressurizing portion
26: partial lock receiving portion
27: full lock receiving portion
28: locking projection
30, 31, 32, 33: side edge
34, 35: side wall
45: jig
46: jig contact portion
47: guiding portion
50A, 50B: edge
51, 52: easily bendable portion
60, 160, 260: first facing surface
61, 161, 261: second facing surface
62, 162, 262: first fitting portion
63, 163, 263: second fitting portion
64, 164, 264: lower contact surface (contact surface)
66, 166: recess
267: through hole
68: upper contact surface

What is claimed is:

1. A terminal connected to a front end part in an extending direction of a wire, comprising:

a terminal body including a sandwiching portion configured to sandwich the wire; and a slide portion slidable along the extending direction of the wire with respect to the terminal body, wherein:

the slide portion includes a pressurizing portion configured to pressurize the sandwiching portion toward the wire, the terminal body is formed by a metal plate material in a bent state, the sandwiching portion includes a holding protrusion projecting toward the wire to contact the wire, the holding protrusion is formed by folding a tip portion of the sandwiching portion and overlapping the tip portion on an overlapping portion of the sandwiching portion, a first facing surface of the overlapping portion and a second facing surface of the tip portion face each other and are overlapped, a first fitting portion extending in a perpendicular direction to the extending direction of the wire that is a front-rear direction of the terminal body and having an elongated shape is provided on the first facing surface, a second fitting portion extending in the perpendicular direction to the extending direction of the wire and having the elongated shape is provided on the second facing surface, and the first and second fitting portions are concavo-convexly fit from each other, the pressurizing portion includes an upper pressurizing portion and a lower pressurizing portion arranged in parallel and extending in a front-rear direction of the slide portion, and an edge formed on a front end of the tip portion is located between the upper pressurizing portion and the lower pressurizing portion.

2. The terminal of claim 1, wherein:

the tip portion of the sandwiching portion has a contact surface configured to contact the wire on a surface opposite to the second facing surface, the contact surface is formed with a recess, and a part of the tip portion corresponding to the recess is formed with the second fitting portion projecting from the second facing surface.

3. The terminal of claim 1, wherein:

the tip portion of the sandwiching portion has a contact surface configured to contact the wire on a surface opposite to the second facing surface, the tip portion is provided with a through hole penetrating through the contact surface and the second facing surface, an opening of the through hole in the second facing surface serves as the second fitting portion, and the first fitting portion is shaped to project from the first facing surface toward the second fitting portion at a position corresponding to the second fitting portion.

4. The terminal of claim 1, wherein a plurality of the first fitting portions and a plurality of the second fitting portions are provided while being spaced apart in the extending direction of the wire.

5. A wire with terminal, the terminal comprising:

a terminal body including a sandwiching portion configured to sandwich the wire; and a slide portion slidable along the extending direction of the wire with respect to the terminal body, wherein:

the slide portion includes a pressurizing portion configured to pressurize the sandwiching portion toward the wire, the terminal body is formed by a metal plate material in a bent state, the sandwiching portion includes a holding protrusion projecting toward the wire to contact the wire, the holding protrusion is formed by folding a tip portion of the sandwiching portion and overlapping the tip portion on an overlapping portion of the sandwiching portion, a first facing surface of the overlapping portion and a second facing surface of the tip portion face each other and are overlapped, a first fitting portion extending in an elongated shape and in a perpendicular direction to the extending direction of the wire that is a front-rear direction of the terminal body is provided on the first facing surface, a second fitting portion extending in the elongated shape and in the perpendicular direction to the extending direction of the wire is provided on the second facing surface, and the first and second fitting portions are concavo-convexly fit from each other, the pressurizing portion includes an upper pressurizing portion and a lower pressurizing portion arranged in parallel and extending in a front-rear direction of the slide portion, an edge formed on a front end of the tip portion is located between the upper pressurizing portion and the lower pressurizing portion, and the wire is connected to the terminal.

6. The terminal of claim 1, wherein each of the first facing surface and the second facing surface is a part of a same surface of the sandwiching portion such that the first fitting portion and the second fitting portion are provided on the same surface of the sandwiching portion.

7. The terminal of claim 1, wherein the tip portion of the sandwiching portion is folded in the front-rear direction of the terminal body and overlapped on the overlapping portion of the sandwiching portion.

* * * * *